United States Patent [19]

Ezaki et al.

[11] Patent Number: 4,585,733

[45] Date of Patent: Apr. 29, 1986

[54] METHOD OF PREPARING SILVER HALIDE PHOTOGRAPHIC EMULSION

[75] Inventors: Atsuo Ezaki; Morio Enomoto; Takehisa Kishita; Kazuo Takahashi, all of Hino, Japan

[73] Assignee: Konishiroku Photo Ind. Co., Ltd., Tokyo, Japan

[21] Appl. No.: 607,172

[22] Filed: May 4, 1984

[30] Foreign Application Priority Data

May 18, 1983 [JP] Japan ..... 58-88220

[51] Int. Cl.[4] ..... G03C 1/36

[52] U.S. Cl. ..... 430/569; 430/606; 430/567

[58] Field of Search ..... 430/567, 605, 949, 606, 430/569

[56] References Cited

U.S. PATENT DOCUMENTS

| | | | |
|---|---|---|---|
| 4,067,739 | 1/1978 | Lewis | 430/567 |
| 4,301,241 | 11/1981 | Saito | 430/567 |
| 4,399,215 | 8/1983 | Wey | 430/567 |
| 4,452,882 | 6/1984 | Akimura et al. | 430/567 |

FOREIGN PATENT DOCUMENTS

| | | |
|---|---|---|
| 149030 | 11/1981 | Japan . |
| 149031 | 11/1981 | Japan . |
| 92523 | 6/1982 | Japan . |
| 92524 | 6/1982 | Japan . |
| 197534 | 12/1982 | Japan . |

*Primary Examiner*—Won H. Louie

*Attorney, Agent, or Firm*—Frishauf, Holtz, Goodman & Woodward

[57] ABSTRACT

A method of preparing a silver halide photographic emulsion comprising silver chloride as a principal component, which comprises adding to an aqueous solution of a hydrophilic colloid, an aqueous solution of a water-soluble silver salt and an aqueous solution of a water-soluble halide according to a simultaneous mixing method, and maintaining the rate of addition of the aqueous solution of a water-soluble silver salt and that of the aqueous solution of a water-soluble halide at a level not higher than the critical growth rate of silver halide grains and, at the same time, setting and maintaining the EAg value during the addition of the aqueous solution of a water-soluble silver salt and the aqueous solution of a water-soluble halide to a level not lower than 130 mV and not higher than 160 mV, said silver halide photographic emulsion being prepared in the presence of a water-soluble rhodium salt which is added during the course of emulsification and physical ripening of the emulsion.

20 Claims, No Drawings

METHOD OF PREPARING SILVER HALIDE PHOTOGRAPHIC EMULSION

BACKGROUND OF THE INVENTION

This invention relates to a method of preparing a silver halide photographic emulsion. More particularly, it relates to a method of preparing a ultra-slow speed silver halide photographic emulsion to be used for a lightroom light-sensitive material for making a graphic art film.

In recent years, in the field of graphic arts, there is an increase in colored and/or complex print products. Further, there has been developed a color scanner for which improved efficiency of a contact work has been particularly desired. Especially, the contact work in a light room has greatly contributed to the improvement in the operation efficiency and the proportion of the lightroom contact work has been increased year by year.

The lightroom contact work can be made practicable by both the improvement in mechanical factors such as contact printers and the improvement in light-sensitive materials.

Referring to light-sensitive materials, there has been developed a light-sensitive silver halide photographic material called a lightroom light-sensitive material, which can be handled in a light room and has a ultra-low sensitivity (1/10,000 to 1/100,000 of the sensitivity of a conventional film for darkroom contact work), and it has been attempted to provide materials of higher quality by imparting to the lightroom light-sensitive material the adaptability to lithographic development. However, none of the conventional materials have satisfied commercial needs.

On the other hand, in order to enhance the quality of the materials, it is considered useful to improve the method of preparing silver halide grains for the photographic emulsion. For example, it has been proposed to control pH conditions, pAg conditions, etc., and to improve a mixing method.

However, when these known methods of preparation of silver halide grains are applied in preparation of a photographic emulsion for the lightroom light-sensitive material, they are unsatisfactory from the viewpoints of gamma, fog and toe cut(herein meant by the contrast at the toe) in the photographic characteristic curve; dot quality; etc. To solve these problems, the present inventors have made studies about preparation method for silver halide grains which may have improved characteristics. As a result, they had an idea that such improved characteristics may be attained by providing a monodispersed emulsion.

By the way, the lightroom light-sensitive material herein mentioned is used at a light place (of illuminance of about 200 lux), and therefore the silver halide to be selected is set to have composition principally comprised of silver chloride in view of the sensitivity region. (This can be inferred from the disclosures in Japanese Unexamined Patent Publication Nos. 149030/1981 and 149031/1981).

In general, silver chloride is known to have a crystal growth rate which is faster than that of silver bromide and also to readily form cubic grains whose crystal habit have (100) face even when pH and pAg has varied. For this reason, a monodispersed emulsion can be readily obtained. On the other hand, it has been proposed in the above Japanese Unexamined Patent Publication Nos. 149030/1981 and 149031/1981 a lightroom light sensitive material employing a water-soluble rhodium salt as a desensitizer.

However, when the sensitivity of the silver halide grains has been set to a ultra-low sensitivity as used in the lightroom light-sensitive material, a conventional usual method for preparation of a monodispersed emulsion can not be applied as such to obtain silver halide grains being of high quality, in particular, high contrast and low fog. This is considered presumably due to the inhibition of formation and growth of the grains by the water-soluble rhodium salt used as a desensitizer.

SUMMARY OF THE INVENTION

It is an object of this invention to provide a method of preparing a silver halide photographic emulsion, capable of producing a lightroom light-sensitive material of high quality, and more specifically, to provide a preparation method capable of producing an emulsion of high contrast in the first instance and of low fog in the second instance.

Such an object can be attained by this invention to be described in the following.

Namely, this invention is a method of preparing a silver halide photographic emulsion, which comprises, when preparing a silver halide photographic emulsion containing the silver halide comprising silver chloride as a principal component, adding to an aqueous solution of a hydrophilic colloid an aqueous solution of a water-soluble silver salt and an aqueous solution of a water-soluble halide according to a simultaneous mixing method, while maintaining the rate of addition of the aqueous solution of a water-soluble silver salt and that of the aqueous solution of a water-soluble halide to a level not higher than the critical growth rate of silver halide grains and, at the same time, setting EAg value at the time of the addition of the aqueous solution of the water-soluble silver salt and the aqueous solution of the water-soluble halide to a level not lower than 130 mV and not higher than 160 mV, said silver halide photographic emulsion being prepared in the presence of a water-soluble rhodium salt.

As is readily presumable in general, usually, the lower the EAg value is in the system where the aqueous solution of a water-soluble silver salt and the aqueous solution of a water-soluble halide are added according to the simultaneous mixing method at a rate not higher than the critical growth rate of silver halide grains, the lower the fog of the thus formed silver halide grains becomes. However, in the case of the emulsion for the lightroom light-sensitive material according to this invention, which contains the silver halide comprising silver chloride as a principal component and is prepared in the presence of a water-soluble rhodium salt, there was found a new fact that, when the EAg value becomes lower than 130 mV, the fog becomes higher on the contrary and yet the distribution of grains readily broadens. This invention has thus been accomplished.

DESCRIPTION OF THE PREFERRED EMBODIMENTS

Embodiments of this invention will be described below in detail.

In this invention, the composition of the silver halide comprises silver chloride as a principal component. This herein means that the silver halide in the emulsion consists of silver chloride alone, or silver chlorobromide or silver chloroiodobromide in which silver chloride is contained in an amount of not less than 80 mole %, preferably of not less than 90 mole %.

If the silver chloride content becomes less than 80 mole %, the photographic performance will result in low contrast and the safety when handled under white light illumination will be lowered, whereupon the workability as the lightroom light-sensitive material will be lowered.

The water-soluble rhodium salt used in this invention may include rhodium dichloride, rhodium trichloride, hexachlororhodium acid ammonium salt, etc., and preferably a complex of rhodium trichloride and a halogen. The amount of the rhodium compounds to be added is preferably $10^{-3}$ to $10^{-5}$ mole per mole of the silver halide.

Addition of the water-soluble rhodium salt in an amount exceeding $10^{-3}$ mole will result in a low contrast emulsion although the desensitizing effect may be retained. On the other hand, addition of the same in an amount less than $10^{-5}$ mole will not be effective for the desensitization to a sensitivity necessary for use of the emulsion as a lightroom light-sensitive material which is the intended product in this invention.

When the water-soluble rhodium salt is replaced by iridium salt or the like, such a remarkable desensitizing effect as in the case where the water-soluble rhodium salt is used can not be obtained.

In this invention, in order to prepare the silver halide emulsion in the presence of a water-soluble rhodium compound, the water-soluble rhodium compound may be added by a known method and at any time during the course of emulsification and physical ripening of the emulsion. In this instance, the emulsion may be prepared preferably by adding the water-soluble rhodium compound at the time of emulsification, and more preferably, by adding it in the aqueous solution of a water-soluble halide.

The EAg value used in the definition of this invention is a concept well known to those skilled in the art, and it denotes silver potential.

In this instance, the EAg value is a value measured by the use of a metallic silver electrode and a saturated Ag/AgCl reference electrode of a double junction type. And, in this invention, the EAg value is a value measured by the method disclosed in Japanese Unexamined Patent Publication No. 197534/1982. This EAg value is kept in the range of not lower than 130 mV and not higher than 160 mV at the time of the addition of materials by the simultaneous mixing method. In particular, it is preferred that the EAg value is substantially kept constant at a certain level of not lower than 130 mV and not higher than 160 mV.

In the above, to substantially keep constant the EAg value at a certain level of not lower than 130 mV and not higher than 160 mV is meant to control it so as to be substantially kept constant at a fixed EAg value.

As a means for controlling precisely the EAg value, it is preferred to devide the aqueous solution of a water-soluble halide (i.e., a halogen ion solution) into two solutions, put one of the solutions to a use for forming silver halide by adding halide ions in an amount substantially equimolar with silver ions to be added in a time unit by the addition of the aqueous solution of a water-soluble silver salt (i.e., a silver ion solution), and put the other of the halogen ion solutions to a use for controlling the EAg value by adding chloride ions and bromide ions so that the quantity variation in EAg value may be kept sufficiently small against the variation of EAg value.

If the EAg value is controlled to be less than 130 mV, an emulsion to be prepared may assume property of low contrast and, moreover, will become high in fog. At the EAg value exceeding 160 mV, on the other hand, which value is near the equimolar point of silver ions and chloride ions, it becomes substantially impossible to control the EAg value and, as a result, the grain size distribution of an emulsion to be prepared will become broadened.

In this invention, the rate of addition is set to be "not higher than a crystal growth rate of silver halide grains". This is meant to be not more than the amount slightly less than the rate of addition (i.e., critical growth rate) of the aqueous solution of a water-soluble silver salt (i.e., silver ion solution) in which new silver halide grain nuclei may have formed and the aqueous solution of a water-soluble halide (i.e., halogen ion solution).

The upper limit value herein mentioned, namely the critical growth rate, may be calculated by confirming formation or non-formation of new crystal nuclei by electron-microscopic observation of a sample taken out of a reaction vessel in an actual reaction system where crystals are actually allowed to become formed while varying the rate of addition of different silver ions and halogen ions.

The "simultaneous mixing method" is herein meant by a method in which the silver ion solution and the halogen ion solution is added simultaneously to the aqueous solution of a hydrophilic colloid to achieve the formation and growth of silver halide grains.

In this invention, mixing of the silver ion solution and the halogen ion solution is carried out by the simultaneous mixing method, e.g., a double jet method. There is no limitation in the manner of mixing if the object of mixing can be attained, but it is more preferred if the homogenization by mixing is faster and the so-called mixing efficiency is higher. This is because, if the mixing efficiency is inferior, the pAg may partially be elevated or lowered to cause changes in the characteristics of monodispersed emulsion.

After completion of the addition of the aqueous solution of a water-soluble silver salt and the aqueous solution of a water-soluble halide, it is preferred in this invention to keep the EAg value at a level not more than 100 mV.

To keep the EAg value at not more than 100 mV after completion of the addition is herein meant to be that at least one of alkali salts such as sodium chloride, potassium chloride, sodium bromide and potassium bromide is added after completion of the addition of the aqueous solution of a water-soluble silver salt and the aqueous solution of a water-soluble halide to make the EAg value in the system not more than 100 mV.

The alkali salts may be added in the form of a solid or an aqueous solution thereof, whichever desired.

The above four kinds of alkali salts, which are preferred for use in this invention, may be used solely or in combination of two or more kinds as a mixed crystal or as an aqueous solution of a mixture of them, whichever desired. Of these alkali salts, however, chloride ion supplying alkali salts such as sodium chloride and potassium chloride are more preferred.

By keeping the EAg value at not more than 100 mV as mentioned above, it becomes possible to obtain a silver halide emulsion which may reduce the quantity of elution of silver in a developing solution and generate less silver sludge.

As the hydrophilic colloid to be used in this invention, there may be employed a water-soluble polymer, for example, natural or synthetic polymers such as gelatin and polyvinyl alcohol. These may be used singly or as a mixture.

There is no specific in the total amount of the hydrophilic colloid, but it is preferably in the range of 0.5 to 100 g based on one liter of the aqueous solution.

Repesentative examples of the aqueous solution of a water-soluble silver salt used in this invention include an aqueous solution of silver nitrate.

Examples of the aqueous solution of a water-soluble halide include an aqueous solution of potassium iodide, sodium iodide, potassium bromide, sodium bromide, potassium chloride or sodium chloride.

In this invention, there is no specific concentration of the aqueous solution of the water-soluble silver salt and the aqueous solution of the water-soluble halide, but it is preferably 0.5 to 4.0 mol/lit, respectively.

The silver halide photographic emulsion thus prepared is a monodispersed emulsion comprising silver halide grains having a mean grain size preferably of 0.3$\mu$, and more preferably, 0.15 to 0.25$\mu$.

In the above case, there is obtainable a variation coeficient, which is represented by (standard deviation of particle size)/(mean particle size)$\times$100, of not more than 15%, and in particular, not more than 10%. When the variation coeficient exceeds 20%, it becomes difficult to obtain desired photographic characteristics. This is considered to have something to do also with physical ripening or chemical sensitization after formation of the grains, but details thereof are still unknown.

When the mean grain size exceeds 0.3$\mu$, the maximum density is lowered and at the same time the emulsion turns to be of low contrast.

Crystal habit of the grains usually assumes a cube. Sometimes, however, grains of apparently rounded angles are formed.

When preparing the emulsion according to this invention, there may be employed any of an ammonia method, a neutral method and an acidic method. However, the ammonia method is not preferred because it may cause generation of fog and too large a grain size in the case of this invention where the grains comprise the silver chloride in a high content.

It is further possible to subject the emulsion thus prepared to chemical sensitization (e.g., sulfur sensitization, reduction sensitization, etc.) by use of a chemical sensitization. However, no chemical sensitizer may be performed at all.

In this invention, it is possible for the silver halide emulsion to contain a polyethylene oxide compound in order to improve the photographic performance with respect to a solution for the lithographic development. The polyethylene oxide compound is a compound preferably having a hydrophobic group. It is a compound having a substituent of weak affinity to water and containing a polyoxyethylene group. Preferred hydrophobic groups include an alkyl group having 4 to 20 carbon atoms, a polypropylene oxide group, a polybutylene oxide group, a polytetramethylene oxide group and a polymethoxymethylethylene oxide group. Polymerization degree of the polyoxyethylene group is preferably 10 to 100.

The silver halide emulsion according to this invention may contain a variety of additives for photography. For instance, as an antifoggant, there may be used any of antifoggants known in the art, including azaindenes, more specifically, 4-hydroxy-6-methyl-1,3,3a,7-tetrazaindene; triazoles; thiazols and tetrazoles. As a hardening agent, there may be used aldehyde compounds, ketone compounds, halo-substituted acids such as mucochloric acid, ethylene imine compounds, etc. As a spreading agent, there may be used saponin, lauryl or oleyl monoether of polyethylene glycol, etc. As a development accelarator, there is no limitation, but may be used, for example, a compound as disclosed in Japanese Unexamined Patent Publication No. 24427/1974, quaternary ammonium salt, etc. As a property improver, there may be contained a polymer latex or the like comprising homopolymer or copolymer such as alkylacrylate, alkylmethacrylate and acrylic acid.

To a silver halide emulsion layer or other layer constituting a photographic material and employing this invention, there may be added antistatic agents such as those disclosed in, for example, Japanese Unexamined Patent Publications Nos. 56220/1976 and 46733/1974.

As a support to be coated with the light-sensitive emulsion, there may be employed any of, for example, polyethylene terephthalate film, polycarbonate film, polystyrene film, cellulose acetate film, baryta paper, laminated paper, glass, etc., provided that a transparent support is suitable for use.

It is preferred that a non-sensitive layer is provided on a light-sensitive silver halide emulsion layer and the reverse side of the support.

A light-sensitive silver halide photographic material to be prepared as in the above is first of all exposed to light. In the instant case, it is preferred to carry out the exposure through a dot original in accordance with graphic art processing. At this time, used as an exposure source is a light source rich in ultraviolet rays.

Next, development is carried out. Development may be carried out according to a conventional method for processing of lightroom light-sensitive material. In such a case, the development can be carried out in a light room using various kind of light sources keeping away from ultraviolet light.

The silver halide photographic emulsion according to this invention has very high gamma and high contrast, and also becomes very low in fog. As a result, an emulsion useful for a lightroom light-sensitive material of very high quality can be obtained.

This invention is described below in greater detail by the following examples, by which, however, this invention is not limited.

EXAMPLE 1

Silver halide emulsions EM-1 to EM-8 were prepared by use of solutions shown below as Solution A, Solution B and Solution C.

| | |
|---|---|
| [Solution A] | |
| Ossein gelatin | 17 g |
| 10% Ethanolic aqueous solution of polyisopropylene-polyethyleneoxy-disuccinic acid sodium salt | 5 ml |
| Distilled water | 1280 cc |
| [Solution B] | |
| Silver nitrate | 170 g |
| Distilled water | 410 ml |
| [Solution C] | |
| Sodium chloride | 58.5 g |
| Ossein gelatin | 11 g |
| 10% Ethanol aqueous solution of | 3 ml |

-continued

| | |
|---|---|
| polyisopropylene-polyethyleneoxy-disuccinic acid sodium salt | |
| Rhodium trichloride trihydrate | 30 mg |
| Distilled water | 412 ml |

Sodium chloride was added to Solution A to have the EAg value as each prescribed in Table 1, followed by further addition of Solution B and Solution C at 40° C. in the time as shown in Table 1 according to a double jet method by use of a stirrer as disclosed in the specification of Japanese Unexamined Patent Publications Nos. 92523/1982 and 92524/1982.

TABLE 1

EAg value and addition time set for each solution

| EM No. | EAg value (mV) | Addition time (min.) |
|---|---|---|
| EM-1 (Control) | 165 | 40 |
| EM-2 (Invention) | 150 | 35 |
| EM-3 (Invention) | 140 | 30 |
| EM-4 (Invention) | 130 | 25 |
| EM-5 (Control) | 120 | 22 |
| EM-6 (Control) | 110 | 20 |
| EM-7 (Control) | 100 | 18 |
| EM-8 (Control) | 90 | 15 |

Rate of addition was made to vary so that the amounts of solutions may increase with lapse of time as shown in Tables 2 to 9.

TABLE 2

Rate of addition for EM-1 (EAg: 165 mV, Addition time: 40 min.)

| Time (min.) | Solution B (ml/min.) | Solution C (ml/min.) |
|---|---|---|
| 0 | 4.4 | 4.3 |
| 2 | 4.4 | 4.3 |
| 6 | 6.7 | 6.6 |
| 9 | 8.1 | 7.9 |
| 14 | 9.9 | 9.7 |
| 18 | 11.2 | 11.0 |
| 22 | 12.2 | 12.0 |
| 25 | 13.1 | 12.8 |
| 29 | 13.9 | 13.6 |
| 34 | 15.0 | 14.7 |
| 38 | 15.9 | 15.6 |
| 40 | 16.4 | 16.1 |

TABLE 3

Rate of addition for EM-2 (EAg: 150 mV, Addition time: 35 min.)

| Time (min.) | Solution B (ml/min.) | Solution C (ml/min.) |
|---|---|---|
| 0 | 5.5 | 5.4 |
| 2 | 5.5 | 5.4 |
| 5 | 7.9 | 7.7 |
| 8 | 9.5 | 9.3 |
| 10 | 10.6 | 10.4 |
| 12 | 11.5 | 11.3 |
| 15 | 12.8 | 12.5 |
| 18 | 13.8 | 13.5 |
| 22 | 15.3 | 15.0 |
| 26 | 16.6 | 16.3 |
| 30 | 17.7 | 17.3 |
| 32 | 18.3 | 17.9 |
| 35 | 19.0 | 18.6 |

TABLE 4

Rate of addition for EM-3 (EAg: 140 mV, Addition time: 30 min.)

| Time (min.) | Solution B (ml/min.) | Solution C (ml/min.) |
|---|---|---|
| 0 | 6.8 | 6.7 |
| 2 | 6.8 | 6.7 |
| 5 | 9.5 | 9.3 |
| 9 | 12.4 | 12.2 |
| 13 | 14.5 | 14.2 |
| 18 | 17.0 | 16.7 |
| 21 | 18.5 | 18.1 |
| 24 | 19.7 | 19.3 |
| 27 | 21.0 | 20.6 |
| 30 | 21.9 | 21.5 |

TABLE 5

Rate of addition for EM-4 (EAg: 130 mV, Addition time: 25 min.)

| Time (min.) | Solution B (ml/min.) | Solution C (ml/min.) |
|---|---|---|
| 0 | 8.8 | 8.6 |
| 2 | 8.8 | 8.6 |
| 5 | 12.8 | 12.5 |
| 8 | 15.3 | 15.0 |
| 11 | 17.8 | 17.4 |
| 14 | 19.7 | 19.3 |
| 17 | 21.5 | 21.1 |
| 20 | 23.4 | 22.9 |
| 23 | 24.9 | 24.4 |
| 25 | 26.0 | 25.5 |

TABLE 6

Rate of addition for EM-5 (EAg: 120 mV, Addition time: 22 min.)

| Time (min.) | Solution B (ml/min.) | Solution C (ml/min.) |
|---|---|---|
| 0 | 10.5 | 10.3 |
| 2 | 10.5 | 10.3 |
| 5 | 14.9 | 14.6 |
| 8 | 18.1 | 17.7 |
| 11 | 21.3 | 20.9 |
| 14 | 23.4 | 22.9 |
| 17 | 25.7 | 25.2 |
| 20 | 27.9 | 27.3 |
| 22 | 29.1 | 28.5 |

TABLE 7

Rate of addition for EM-6 (EAg: 110 mV, Addition time: 20 min.)

| Time (min.) | Solution B (ml/min.) | Solution C (ml/min.) |
|---|---|---|
| 0 | 12.0 | 11.8 |
| 2 | 12.0 | 11.8 |
| 5 | 17.0 | 16.7 |
| 8 | 20.6 | 20.2 |
| 11 | 24.1 | 23.6 |
| 14 | 26.8 | 26.3 |
| 17 | 29.6 | 29.0 |
| 20 | 31.9 | 31.3 |

TABLE 8

Rate of addition for EM-7 (EAg: 100 mV, Addition time: 18 min.)

| Time (min.) | Solution B (ml/min.) | Solution C (ml/min.) |
|---|---|---|
| 0 | 14.0 | 13.7 |
| 2 | 14.0 | 13.7 |
| 5 | 20.3 | 19.9 |
| 7 | 23.1 | 22.6 |
| 9 | 25.6 | 25.1 |

TABLE 8-continued

| Rate of addition for EM-7 (EAg: 100 mV, Addition time: 18 min.) | | |
|---|---|---|
| Time (min.) | Solution B (ml/min.) | Solution C (ml/min.) |
| 11 | 28.0 | 27.4 |
| 13 | 30.3 | 29.7 |
| 15 | 32.3 | 31.7 |
| 18 | 35.2 | 34.5 |

TABLE 9

| Rate of addition for EM-8 (EAg: 90 mV, Addition time: 15 min.) | | |
|---|---|---|
| Time (min.) | Solution B (ml/min.) | Solution C (ml/min.) |
| 0 | 18.0 | 17.6 |
| 2 | 18.0 | 17.6 |
| 4 | 23.2 | 22.7 |
| 6 | 27.4 | 26.9 |
| 8 | 31.3 | 30.7 |
| 10 | 34.5 | 33.8 |
| 12 | 37.5 | 36.8 |
| 15 | 41.7 | 40.9 |

In the above, EAg values were controlled to keep the value s as shown in Table 1 by using 3 mol/lit. solution of sodium chloride.

For measurement of the EAg values, employed were a metallic silver electrode and a saturated Ag/AgCl reference electrode of a double junction type (i.e., the electrode of double junction construction as disclosed in Japanese Unexamined Patent Publication No. 197534/1982).

For addition of the solutions of Solution B and Solution C, employed was a roller tube metering pump of a variable flow rate type.

In the above instances, the time of addition was made to vary for each sample to use the experimentally predetermined addition time in order to make substantially uniform the mean grain size of the silver halide grains to be formed.

During the addition, sampling of the emulsions was carried out to observe by use of an electron microscope no formation of new grains in the system, thereby comfirming that the amount of addition did not exceed the critical grain growth rate in the system.

During the addition, the pH was also controlled to be 5.5 by use of an aqueous solution of 1% sulfuric acid.

After completion of the addition of Solution B and Solution C, all the emulsions were subjected to Ostwald ripening for 10 minutes and then to desalting, washing with water, followed by addition of 600 ml of an aqueous solution of ossein gelatin (containing 30 g of ossein gelatin) which was dispersed by stirring at 55° C. for 30 minutes to make up 750 cc of the emulsion.

The EM-1 to EM-8 thus obtained were observed by an electron microscope to determine the mean grain size and the coefficient of variation. Results are shown in Table 10.

TABLE 10

| Mean grain size and grain size distribution of the emulsions | | |
|---|---|---|
| EM No. | Mean grain size (μ) | Grain size distribution (%)* |
| EM-1 (Control) | 0.19 | 15 |
| EM-2 (Invention) | 0.19 | 8 |
| EM-3 (Invention) | 0.20 | 8 |
| EM-4 (Invention) | 0.21 | 10 |

TABLE 10-continued

| Mean grain size and grain size distribution of the emulsions | | |
|---|---|---|
| EM No. | Mean grain size (μ) | Grain size distribution (%)* |
| EM-5 (Control) | 0.20 | 15 |
| EM-6 (Control) | 0.20 | 15 |
| EM-7 (Control) | 0.20 | 15 |
| EM-8 (Control) | 0.19 | 15 |

*Grain size distribution (variation coefficient):

$$\text{Variation coefficient} = \frac{\text{standard deviation of grain size}}{\text{mean grain size}} \times 100$$

As shown in Table 10, there were prepared substantially the similar emulsions when viewed from the mean grain size, as the emulsions EM-1 to EM-8 show the mean grain size of 0.20μ±0.01. It is seen that emulsions EM-2, EM-3 and EM-4 which are inside this invention are monodispersed emulsions of less coefficient of variation as compared with control emulsions.

Further, added to these emulsions each was a small amount of sodium thiosulfate to make chemical sensitization while selecting the conditions for the chemical sensitization so as to provide emulsions each having substantially the same sensitivity. Each of the emulsions thus treated was followed by further addition of 6-methyl-4-hydroxy-1,3,3a,7-tetraazaindene as a stabilizing agent, saponin as a spreading agent and formalin as a hardening agent, and then applied by coating on a PET base to have a silver amount of 3.5 g/m$^2$ and dried.

Specimens thus obtained were subjected to wedge exposure by use of a lightroom printer (HMW-215, manufactured by ORC Seisakusho Co.), and then to development at 38° C. for 20 seconds by use of Developer I having the following composition (a Phenydone-hydroquinone developer (trade name CMD-621 produced by Konishiroku Photo Industry Co., Ltd.). The results are shown in Table 11.

| [Developer I] | |
|---|---|
| EDTA.2Na | 2 g |
| 5-Methylbenztriazole | 1 g |
| 1-Phenyl-5-mercaptotetrazole | 0.36 g |
| KOH in an amount to make pH to | 10.4 |
| $K_2SO_3$ | 253 g |
| KBr | 13 g |
| Hydroquinone | 80 g |
| $K_2CO_3$ | 40 g |
| Diethylene glycol | 100 g |
| 1-Phenyl-4,4-dimethyl-3-pyrazolidinone | 1.4 g |
| Add $H_2O$ to make up 1 liter (pH = 10.4) | |

In actual use, one liter of the above stock solution was diluted with 3 liter of $H_2O$.

TABLE 11

| Performances of the emulsions | | | |
|---|---|---|---|
| Emulsion used | Sensitivity*1 | Gamma*2 | Fog |
| EM-1 | 105 | 5.0 | 0.04 |
| EM-2 | 100 | 6.5 | 0.04 |
| EM-3 | 103 | 6.5 | 0.04 |
| EM-4 | 110 | 6.0 | 0.05 |
| EM-5 | 95 | 5.5 | 0.08 |
| EM-6 | 93 | 5.0 | 0.12 |
| EM-7 | 100 | 5.0 | 0.23 |

TABLE 11-continued

| Emulsion used | Performances of the emulsions | | |
|---|---|---|---|
| | Sensitivity*1 | Gamma*2 | Fog |
| EM-8 | 107 | 5.0 | 0.35 |

*1Sensitivity at the density of 2.5, shown as relative sensitivity to that of EM-2 assumed as 100.
*2A value of tan θ at the straight line portion of from 1.0 to 2.5 on the photographic characteristic curve.

As shown in Table 11, it is seen that the emulsions EM-2, EM-3 and EM-4 which are in accordance with this invention are emulsions of low fog and high contrast.

EXAMPLE 2

Added to each of the emulsions EM-1 to EM-8 prepared in Example 1 was a small amount of sodium thiosulfate to make chemical sensitization in the same manner as in Example 1. Each of the emulsions thus treated was followed by further addition of 700 mg of a polyalkyleneoxide compound $n\text{-}C_{12}H_{25}O(CH_2CH_2O)_{30}H$ per mole of silver halide, addition of polyethylene glycol having mean molecular weight of 1500, stabilization by use of 4-hydroxy-6-methyl-1,3,3a,7-tetrazaindene, further addition of formalin as a hardening agent and saponin as a spreading agent, and then applied on a PET base by coating to have a silver amount of 3.5 g/m$^2$ and dried.

Specimens thus obtained were subjected to wedge exposure in the same manner as in Example 1, and then to development at 32° C. for 60 seconds by use of Developer II having the following composition (a lithographic developer, tradename CDL-271 produced by Konishiroku Photo Industry Co., Ltd.). Results are shown in Table 12.

| [Developer II] | |
|---|---|
| Composition A: | |
| Triethylene glycol | 40 g |
| Polyethylene glycol (mean molecular weight 1500) | 0.4 g |
| Formaldehyde - sodium hydrogensulfite adduct | 50 g |
| Hydroquinone | 15 g |
| Diethanolamine | 7 g |
| Potassium sulfite | 1.5 g |
| Add water to make up | 167 ml. |
| Composition B: | |
| Triethylene glycol | 9 g |
| 5-Nitroindazole | 6 g |
| Disodium ethylenediaminetetraacetate | 6 g |
| Boric acid | 2 g |
| Potassium bromide | 2 g |
| Potassium carbonate | 50 g |
| Potassium sulfite | 2.5 g |
| Sodium hydroxide | 1 g |
| Add water to make up | 167 ml. |

The above was used in the ratio of Composition A:-Composition B:water=1:1:4 (volume ratio)

TABLE 12

| Emulsions used | Lithographic development performances of the emulsions | |
|---|---|---|
| | Gamma | Fog |
| EM-1 | 10.0 | 0.03 |
| EM-2 | 14.0 | 0.03 |
| EM-3 | 14.0 | 0.03 |
| EM-4 | 12.0 | 0.03 |
| EM-5 | 11.0 | 0.07 |
| EM-6 | 10.0 | 0.10 |

TABLE 12-continued

| Emulsions used | Lithographic development performances of the emulsions | |
|---|---|---|
| | Gamma | Fog |
| EM-7 | 10.0 | 0.35 |
| EM-8 | 9.5 | 0.48 |

As shown in Table 12, it was possible by use of EM-2, EM-3 and EM-4 to obtain images of lower fog and higher contrast as compared with the control specimens.

EXAMPLE 3

To the Solution C used in Example 1 was added KBr in the amount as shown in Table 13 with prescribed reduction of the amount of addition of sodium chloride to prepare emulsions EM-9, EM-10, EM-11, EM-12 and EM-13, respectively.

In preparing these, Emulsions A and B used were the same as those in Example 1. While setting the EAg value to 140 mV during addition, the solutions were added in the addition time of 30 minutes under the patterns of addition shown in Table 4. In the same manner as in Example 1, emulsions thus obtained were subjected to Ostwald ripening, followed by desalting, washing with water and despersion step to obtain emulsions EM-9, EM-10, EM-11, EM-12 and EM-13.

TABLE 13

| EM No. | Amount of KBr and NaCl added in Solution C of the emulsions | |
|---|---|---|
| | Amount of KBr (g) | Amount of NaCl (g) |
| EM-9 | 2.4 | 57.3 |
| EM-10 | 4.8 | 56.2 |
| EM-11 | 7.1 | 55.0 |
| EM-12 | 9.5 | 53.8 |
| EM-13 | 11.9 | 52.7 |

For these emulsions, the mean grain size and the grain size distribution were observed in the same manner as in Example 1 to obtain the results as shown in Table 14.

TABLE 14

| EM No. | Mean grain size and grain size distribution of the emulsions | |
|---|---|---|
| | Mean grain size (μ) | Grain size distribution (%) |
| EM-9 | 0.20 | 8 |
| EM-10 | 0.20 | 8 |
| EM-11 | 0.19 | 9 |
| EM-12 | 0.18 | 10 |
| EM-13 | 0.18 | 10 |

In emulsions EM-9 to EM-13, there were obtained grains of grain size of 0.18 to 0.20μ and relatively monodispersed.

Further, having made chemical sensitization, prepared in the same manner as in Example 1 were film specimens, which were developed at 38° C. for 20 seconds by use of the Developer I (CDM-621 produced by Konishiroku Photo Industry Co., Ltd.). Results are shown in Table 15.

TABLE 15

| Emulsion used | Performances of the emulsions | | |
|---|---|---|---|
| | Sensitivity | Gamma | Fog |
| EM-9 | 100 | 6.5 | 0.04 |
| EM-10 | 105 | 6.5 | 0.04 |
| EM-11 | 105 | 6.7 | 0.04 |
| EM-12 | 105 | 6.3 | 0.04 |

As shown in Table 15, it is seen that the emulsions prepared by the method according to this invention have low fog and high contrast as in the cases of EM-2, 3 and 4 even when the halogen composition of silver halide grains comprises silver chloride as a principal component.

EXAMPLE 4

The preparation of emulsion EM-3 according to Example 1 was repeated except that an aqueous solution of sodium chloride (3 mol/l) was added in five minutes after completion of the addition of Solutions B and C so as to keep EAg value at 95 mV, thereby preparing emulsion EM-14. The emulsion thus obtained was subjected to coating and drying in the same manner as in Example 2 to obtain a film specimen, Specimen-1. On the other hand, the emulsion EM-3 of Example 1 was also subjected to coating and drying in the same manner as in Example 2 to obtain Specimen-2. These Specimen-1 and Specimen-2 were developed at 32° C. for 60 seconds by use of Developer II used in Example 2. As a result, both the Specimen-1 and Specimen-2 gave satisfactory gamma and fog.

Further, each of the specimens was subjected to running processing by use of the Developer II used in Example 2, Developer III shown below and a belt-roller transporting type automatic developing machine (LD-250D, manufactured by Dainippon Screen Mfg. Co., Ltd., developing tank of about 60 lit.). Conditions for the running processing were as shown in Table 16 below:

TABLE 16

| Running processing conditions | |
|---|---|
| Automatic Developing machine: | LD-250D |
| Development initiating solution: | Developer II |
| Development replenishing solution: | Developer III |
| Processing conditions: | 32° C., 60 secs. |
| Amount of replenishing solution: | 157 ml/m$^2$ |
| Quantity of running | 300 m$^2$ |
| Blackening area of running specimen: | 30% |

| [Developer III] | |
|---|---|
| Composition A: | |
| Triethylene glycol | 45 g |
| Polyethylene glycol (mean molecular weight 1500) | 0.2 g |
| Formaldehyde - sodium hydrogensulfite adduct | 50 g |
| Hydroquinone | 22 g |
| Diethanolamine | 7 g |
| Potassium sulfite | 1.5 g |
| Add water to make up | 167 ml. |
| Composition B: | |
| Triethylene glycol | 15 g |
| 5-Nitroindazole | 15 g |
| Disodium ethylenediaminetetraacetate | 6 g |
| Potassium bromide | 1.5 g |
| Potassium carbonate | 50 g |
| Potassium sulfite | 9 g |
| Boric acid | 2 g |
| Sodium hydroxide | 4 g |

-continued

| [Developer III] | |
|---|---|
| Add water to make up | 167 ml. |

Each of the specimens was processed in the processing quantity of 50 m$^2$ per day. After running of 300 m$^2$ in the total processing quantity, the developing machine was run idle for one hour without any film processing, stopped, and driven again after 48 hours to make processing of the specimens, whereupon the generation rate of silver sludge sticking to the specimens and the rate of contamination of inside wall of the developing tank were observed to compare and examine the difference. As a result, it was observed that, in the case of Specimen-1, the generation of sludge sticking to the specimen was very small and the contamination of inside wall of the developing tank was also very small, as compared with the case of Specimen-2.

We claim:

1. A method of preparing a silver halide photographic emulsion comprising silver chloride as a principal component, which comprises adding to an aqueous solution of a hydrophilic colloid, an aqueous solution of a water-soluble silver salt and an aqueous solution of a water-soluble halide according to a simultaneous mixing method, maintaining the rate of addition of the aqueous solution of a water-soluble silver salt and that of the aqueous solution of a water-soluble halide at a level not higher than the critical growth rate of silver halide grains and, at the same time, setting and maintaining the EAg value during the addition of the aqueous solution of a water-soluble silver salt and the aqueous solution of a water-soluble halide to a level not lower than 130 mV and not higher than 160 mV and physical ripening of the emulsion, said silver halide photographic emulsion being prepared in the presence of a water-soluble rhodium salt which is added during the course of emulsification and physical ripening of the emulsion.

2. The method according to claim 1, wherein said silver chloride is contained in the emulsion in an amount of not less than 80 mole %.

3. The method according to claim 1, wherein said water-soluble rhodium salt is selected from the group consisting of rhodium dichloride, rhodium trichloride, hexachlororhodium acid ammonium salt and a complex of rhodium trichloride and a halogen.

4. The method according to claim 1, wherein the amount of the rhodium compounds to be added is preferably $10^{-3}$ to $10^{-5}$ mole per mole of the silver halide.

5. The method according to claim 1, wherein said EAg value is substantially kept constant at a fixed level of not lower than 130 mV and not higher than 160 mV.

6. The method according to claim 5, wherein said EAg value is substantially kept constant at a level of 130 mV.

7. The method according to claim 5, wherein said EAg value is substantially kept constant at a level of 140 mV.

8. The method according to claim 5, wherein said EAg value is substantially kept constant at a level of 150 mV.

9. The method according to claim 1, wherein said EAg value is controlled by dividing the aqueous solution of a water-soluble halide into two solutions, using one of the solutions for forming silver halide by adding halide ions in an amount substantially equimolar with silver ions to be added in a time unit with the addition of the aqueous solution of a water-soluble silver salt, and using the other of the solutions for controlling the EAg value by adding chloride ions and bromide ions so that the quantity variation in EAg value may be kept sufficiently small against the variation of EAg value.

10. The method according to claim 1, wherein said hydrophilic colloid is gelatin, polyvinyl alcohol or a mixture of these.

11. The method according to claim 1, wherein the total amount of said hydrophilic colloid is in the range of 0.5 to 100 g based on one liter of the aqueous solution.

12. The method according to claim 1, wherein said aqueous solution of a water-soluble silver salt is an aqueous solution of silver nitrate.

13. The method according to claim 1, wherein the halide in said aqueous solution of a water-soluble halide is selected from the group consisting of potassium iodide, sodium iodide, potassium bromide, sodium bromide, potassium chloride and sodium chloride.

14. The method according to claim 1, further comprising adjusting the EAg value after completion of the addition of the aqueous solution of a water-soluble silver salt and the aqueous solution of a water-soluble halide to a level not more than 100 mV.

15. The method according to claim 5, wherein EAg value after completion of the addition of the aqueous solution of a water-soluble silver salt and the aqueous solution of a water-soluble halide is adjusted to a level of not more than 100 mV.

16. The method according to claim 2, wherein the amount of the rhodium compounds to be added is preferably $10^{-3}$ to $10^{-5}$ mole per mole of the silver halide; said EAg value is substantially kept constant at a fixed level of not lower than 130 mV and not higher than 160 mV; and the total amount of said hydrophilic colloid is in the range of 0.5 to 100 g based on one liter of the aqueous solution.

17. The method according to claim 16, wherein said water-soluble rhodium salt is selected from the group consisting of rhodium dichloride, rhodium trichloride, hexachlororhodium acid ammonium salt and a complex of rhodium trichloride and a halogen; said hydrophilic colloid is gelatin, polyvinyl alcohol or a mixture of these; said aqueous solution of a water-soluble silver salt is an aqueous solution of silver nitrate; and the halide in said aqueous solution of a water-soluble halide is selected from the group consisting of potassium iodide, sodium iodide, potassium bromide, sodium bromide, potassium chloride and sodium chloride.

18. The method according to claim 9, wherein said silver chloride is contained in the emulsion in an amount of not less than 80 mole %; the amount of the rhodium compounds to be added is preferably $10^{-3}$ to $10^{-5}$ mole per mole of the silver halide; said EAg value is substantially kept constant at a fixed level of not lower than 130 mV and not higher than 160 mV; and the total amount of said hydrophilic colloid is in the range of 0.5 to 100 g based on one liter of the aqueous solution.

19. The method according to claim 18, wherein said water-soluble rhodium salt is selected from the group consisting of rhodium dichloride, rhodium trichloride, hexachlororhodium acid ammonium salt and a complex of rhodium trichloride and a halogen; said hydrophilic colloid is gelatin, polyvinyl alcohol or a mixture of these; said aqueous solution of a water-soluble silver salt is an aqueous solution of silver nitrate; and the halide in said aqueous solution of a water-soluble halide is selected from the group consisting of potassium iodide, sodium iodide, potassium bromide, sodium bromide, potassium chloride and sodium chloride.

20. The method according to claim 19, wherein said silver chloride is contained in the emulsion in an amount of not less than 90 mole %.

* * * * *